US011889871B2

(12) United States Patent
Cummings

(10) Patent No.: US 11,889,871 B2
(45) Date of Patent: Feb. 6, 2024

(54) GARMENT SUPPORT

(71) Applicant: ALPHA CLASS, INC., Clearfield, PA (US)

(72) Inventor: Eric E. Cummings, Clearfield, PA (US)

(73) Assignee: Alpha Class, Inc., Clearfield, PA (US)

( * ) Notice: Subject to any disclaimer, the term of this patent is extended or adjusted under 35 U.S.C. 154(b) by 335 days.

(21) Appl. No.: 17/366,346

(22) Filed: Jul. 2, 2021

(65) Prior Publication Data

US 2022/0015461 A1 Jan. 20, 2022

Related U.S. Application Data

(60) Provisional application No. 63/053,934, filed on Jul. 20, 2020.

(51) Int. Cl.
*A41B 15/02* (2006.01)

(52) U.S. Cl.
CPC ..... *A41B 15/02* (2013.01)

(58) Field of Classification Search
CPC .... A41B 15/02; Y10T 24/44923; Y10T 24/32
See application file for complete search history.

(56) References Cited

U.S. PATENT DOCUMENTS 2,269,511 A * 1/1942 Biederman ..... A41B 15/02 2/279
3,072,917 A * 1/1963 Watson, Jr. ..... A41B 15/02 2/279
3,141,221 A * 7/1964 Faulls, Jr. ..... B65D 33/1666 24/30.5 R
3,786,520 A * 1/1974 Harmon ..... A41B 15/02 2/279
4,897,900 A * 2/1990 Baggett ..... A41B 15/02 24/543
5,301,392 A * 4/1994 Richman ..... B65D 33/1675 24/30.5 R
6,003,212 A * 12/1999 Imahata ..... A43B 3/0047 24/324
2012/0023709 A1* 2/2012 Hsu ..... B65D 33/1666 24/30.5 R
2018/0332903 A1* 11/2018 Payne ..... A41B 15/02
2019/0069619 A1* 3/2019 Pandolfino ..... A44B 6/00

* cited by examiner

*Primary Examiner* — Jillian K Pierorazio
(74) *Attorney, Agent, or Firm* — Duane Morris LLP

(57) ABSTRACT

A garment support includes a body including a top portion, a middle portion, and bottom portion, the top portion includes a first leg and a second leg defining a receptacle extending along a length of the body to receive and support a garment, and the bottom portion includes a lower edge that is pointed along the length of the body.

17 Claims, 6 Drawing Sheets

GARMENT SUPPORT

CROSS REFERENCE TO RELATED APPLICATIONS

This application claims the benefit of U.S. Provisional Patent Application No. 63/053,934, filed Jul. 20, 2020, which is hereby incorporated by reference for all purposes as if fully set forth herein.

TECHNICAL FIELD

The disclosed embodiments generally relate to a garment support, and, more particularly, to a handkerchief support for insertion in a pocket.

BACKGROUND

Handkerchiefs placed in suit coat pockets commonly slide out of sight while being worn and thus lose their intended purpose as a visual accessory meant to be seen extending out of the pocket. Individuals may pay large sums of money for handkerchiefs, but may be left with make-shift devices (e.g., folded paper towels or napkins stuffed into the pocket) to keep the accessory visible. The market place is absent an effective solution for this problem. Existing prior art devices do not maintain the integrity of the handkerchief but instead fold and/or pinch the handkerchief, likely resulting in unnatural fold marks and creases.

SUMMARY OF THE INVENTION

To overcome the problems described above and other problems of the prior art, an embodiment of the present disclosure provides a garment support, including a body including a top portion, a middle portion, and a bottom portion, wherein the top portion includes a first leg and a second leg defining a receptacle extending along a length of the body to receive and support the garment; and the bottom portion includes a lower edge that is pointed along the length of the body.

In an embodiment, the first leg and the second leg define a U-shaped receptacle including curved inner and outer surfaces. In an embodiment, the first leg and the second leg are pointed to define thin edges at an end of each of the first leg and the second leg, respectively.

In an embodiment, the body is rectangular. In an embodiment, the top portion includes rounded corners at ends of the top portion.

The garment support can further include a mechanism to adjust a height of the body.

In an embodiment, the first leg and the second leg include curved inner surfaces. The first leg and the second leg can include curved outer surfaces. The first leg and the second leg can be connected by a flat surface. The first leg and the second leg can each include flat angled outer surfaces.

In an embodiment, the body includes a first component and a second component that is removable from the first component. The body can be made up of a first component and a separable second component. The first component can include the top portion and a first connector. The second component can include the bottom portion and a second connector to mate with the first connector. The first connector and the second connector can include a notched projection and a notched aperture, respectively.

The garment support can further include a third component including a third connector to mate with the first connector and a fourth connector to mate with the second connector.

The above and other features, elements, characteristics, steps, and advantages of the present invention will become more apparent from the following detailed description of preferred embodiments of the present invention with reference to the attached drawings.

DETAILED DESCRIPTION

The present disclosure describes, according to embodiments, a garment support for placement inside of a pocket, such as a suit coat lapel pocket, to create a support mechanism for a garment, such as a handkerchief. The garment support may include a flat, rectangular shape and configuration suitable for low-profile positioning inside of a pocket. The garment support may include additional features for maintaining its own position inside of the pocket and for effectively supporting a garment in a desired manner. The garment support may permit the handkerchief to remain folded naturally and allows all of the handkerchief material to be supported and used, thereby achieving a desired volume and look without causing unwanted creases or folds to accommodate the support. According to some embodiments, the garment support effectively moves the bottom of the pocket upward such that the handkerchief is propped up higher, allowing more of the handkerchief to be exposed outside of the pocket.

Figure 1:
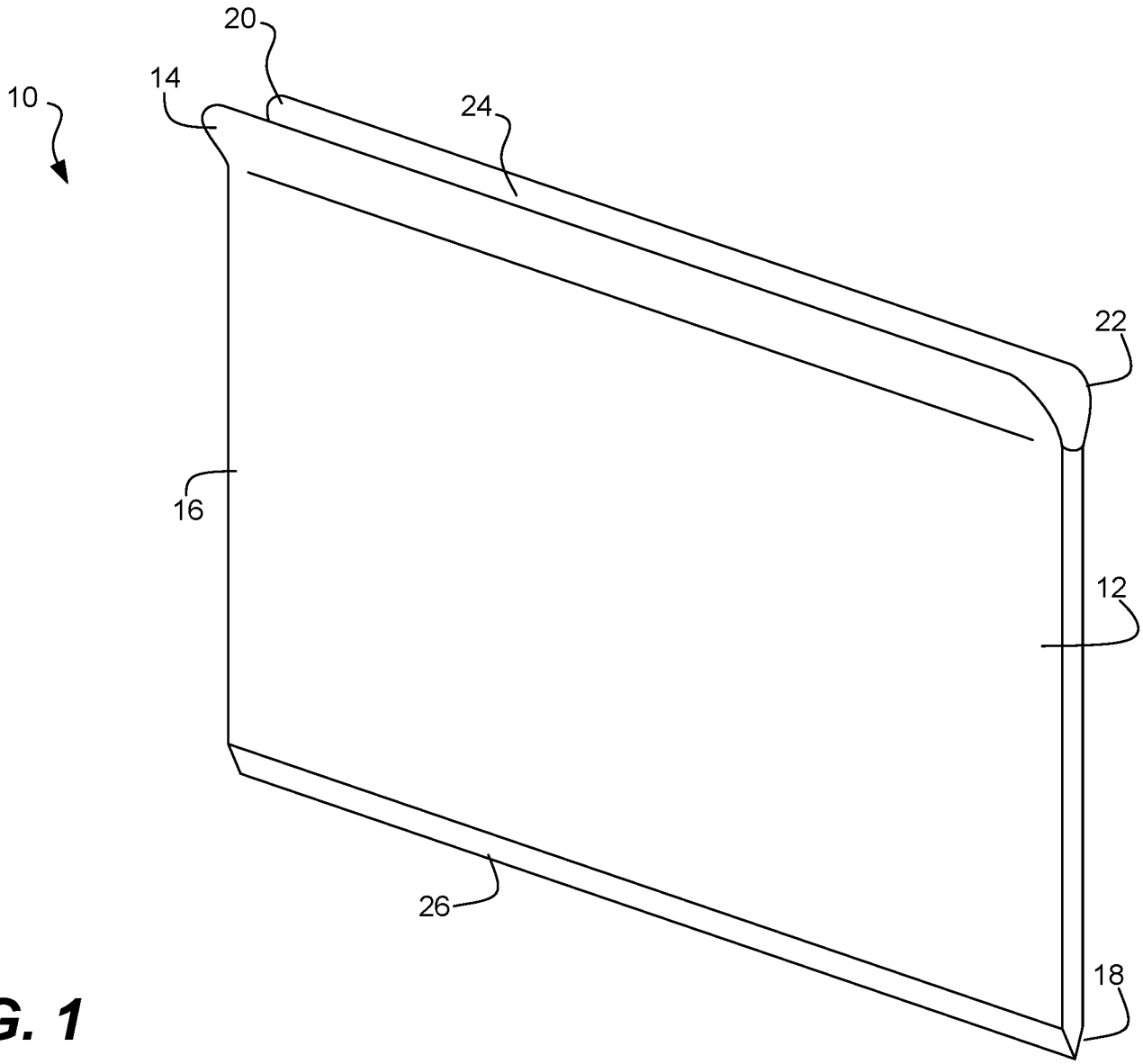
FIG. 1 is a perspective view of an exemplary garment support, consistent with disclosed embodiments.
Figure 6:
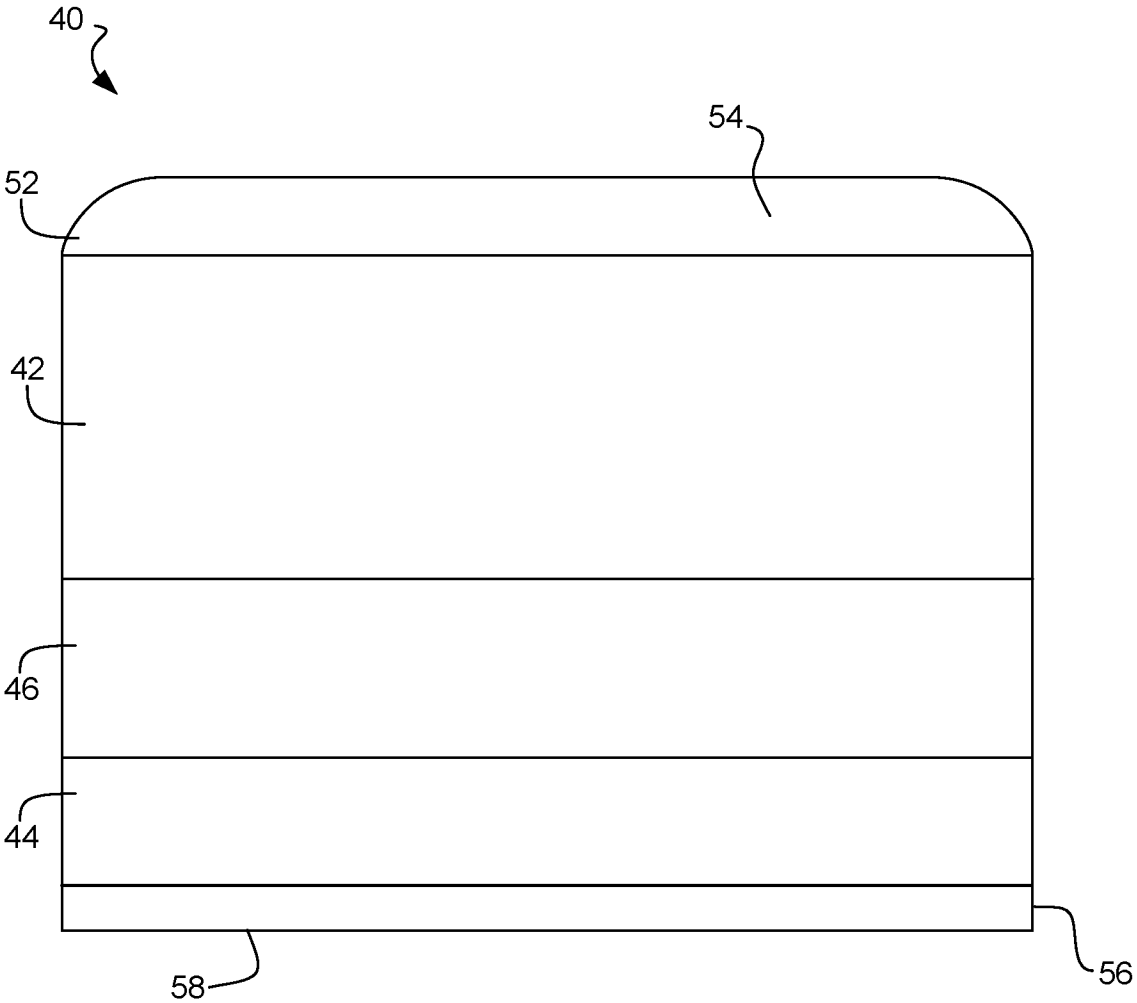
FIG. 6 is a front view of the garment support of FIG. 5, consistent with disclosed embodiments.
Figure 8:
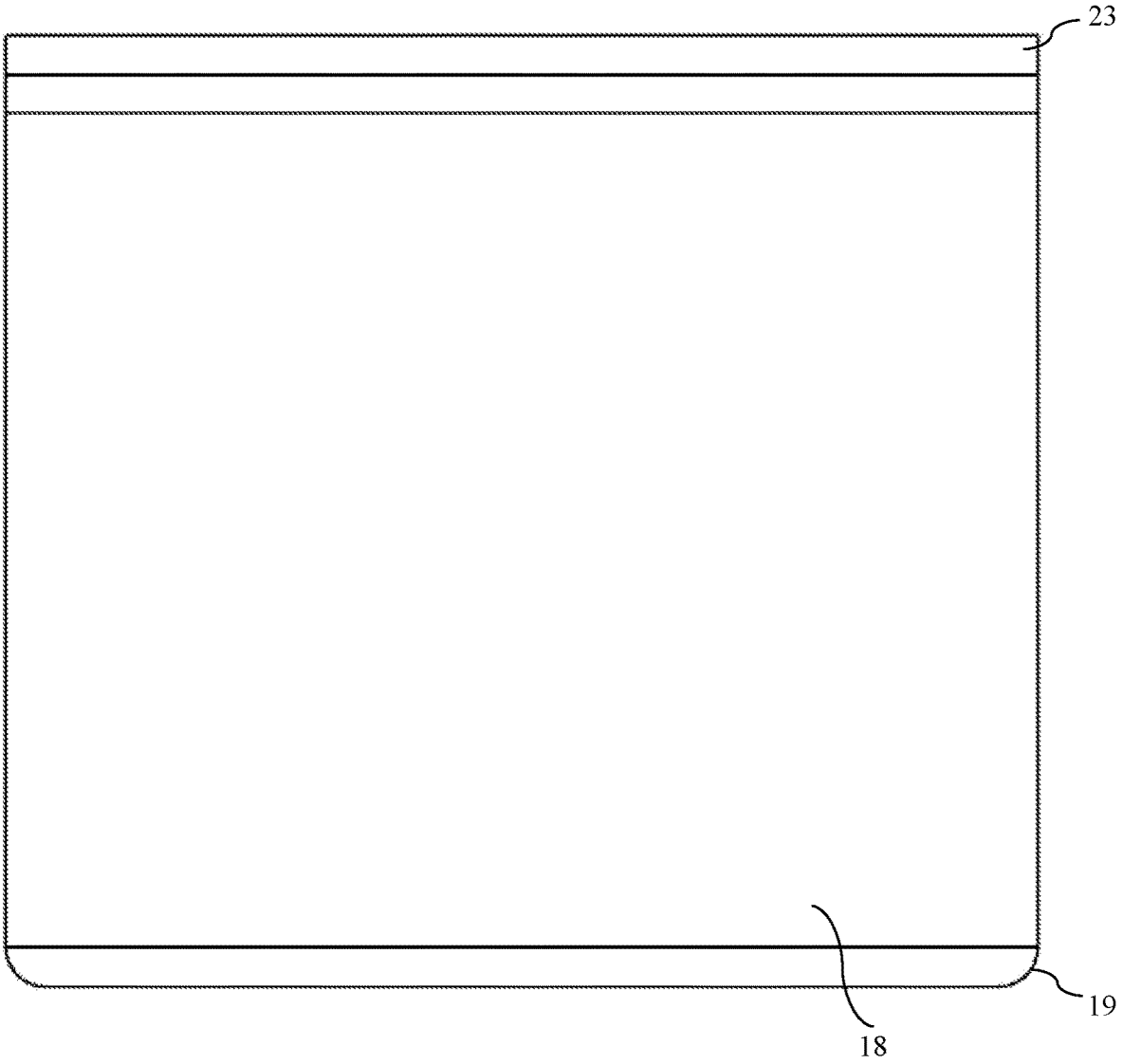
FIG. 8 is a front view of a garment support according to another embodiment of the present disclosure.

FIG. 1 is a perspective view of an embodiment of a garment support 10. The garment support 10 includes a body 12 that may include a flat configuration having a top portion 14, a middle portion 16, and a bottom portion 18. The body 12 may include a profile generally shaped to match the inside of a pocket, such as a suit coat lapel pocket. That is the bottom portion 18 can have square corners like that shown in FIGS. 2 and 6. Optionally, the corners 19 of the bottom portion 18 can be rounded to prevent snagging the garment support 10 inside a suit coat lapel pocket, as shown in FIG. 8. The garment support 10 may be configured to support a handkerchief inside of the pocket without creating additional bulk or bulging of the pocket and may include various feathers to help achieve this function.

Figure 2:
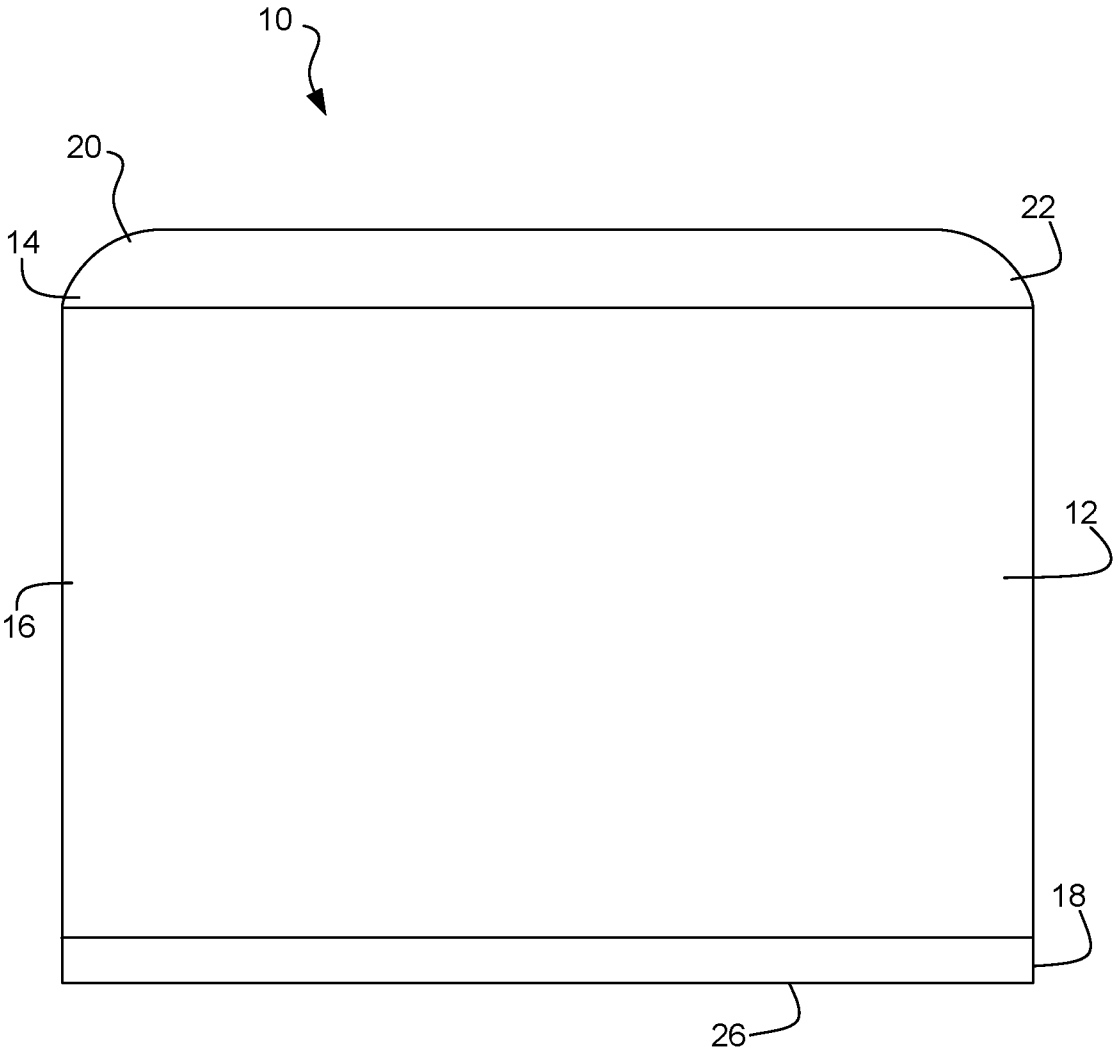
FIG. 2 is a front view of the garment support of FIG. 1, consistent with disclosed embodiments.

FIG. 2 is a front view of the garment support 10. The body 12 may include a generally rectangular shape, but is not limited thereto. The top portion 14 may include rounded corners 20, 22 that help with insertion and removal of the garment support 10 into and out of a pocket. For instance, the rounded corners 20, 22 may help prevent the garment support 10 from snagging on a pocket edge during removal. Optionally, the features at the top portion 14 can have a profile with square corners 23 as shown in FIG. 8. It should be understood that both the corners of the top portion 14 and bottom portion 18 can be rounded corners. The middle portion 16 may be a majority of the body 12 and may include a height selected according to a desired positioning of the garment. For instance, the greater the height of the middle portion 16, the higher a handkerchief would be propped up inside of the pocket. In some embodiments, the height of the middle portion 16 may be variable. For example, the body 12 may include a sliding, collapsing, expanding, and/or hinged mechanism to allow a user to change the size of the body 12 (e.g., change the height of the middle portion 16).

Figure 3:
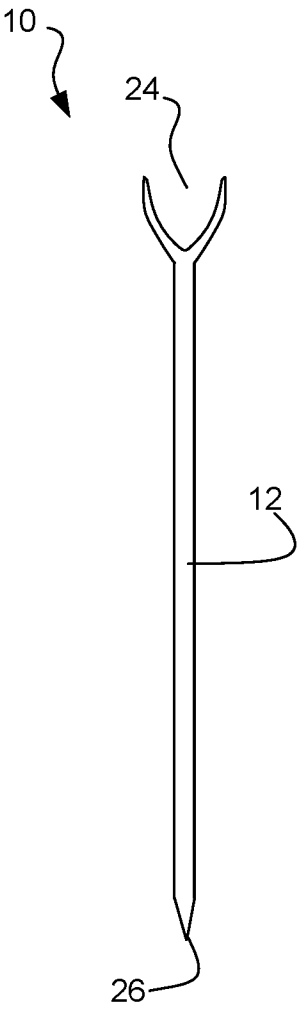
FIG. 3 is a side view of the garment support of FIG. 1, consistent with disclosed embodiments.

FIG. 3 is a side profile view of the garment support 10. The top portion 14 may include a receptacle 24 that runs a length of the garment support 10 and creates a trough or small pocket for receiving and propping up a garment, such as a handkerchief. In an exemplary embodiment, the bottom portion 18 may converge into a thin edge 26. The thin edge 26 may come to an approximate point to conform to a bottom seam of a pocket and fit snugly inside of a pocket.

The garment support 10 is illustrated with a rectangular shape but could be adapted to any size and shape configuration to conform to a particular pocket, for example. In an exemplary embodiment, the garment support may include a width of approximately 3.25 in. In some embodiments, the garment support 10 may include a height based on a desired level at which to support a garment and a pocket size. For example, the garment support 10 may include a height of 2.25 in., 2.5 in., or 2.75 in. In some embodiments, the garment support 10 may be included in a kit containing multiple garment supports 10 having different sizes (e.g., different heights). The middle portion 16 may include a majority of the height with the top portion being, for example, 0.25 in. in height and the bottom portion being, for example, 0.125 in. in height. The body 12 of the garment support 10 may include a nominal thickness (in a side view) sized to maintain a sturdy structure while avoiding bulk when placed in a pocket. For example, the middle portion 16 may include a thickness of approximately 0.0625 in. The top portion 14 may be thicker (in a side view) than the middle portion 16 to create the receptacle 24. For example, the top portion 14 may include a thickness of approximately 0.25 in.

The garment support 10 may be constructed from any of a variety of materials providing a desired strength, rigidity, and appearance. For example, any portion of the garment support 10 can be made from polymers, metal (e.g., steel), alloys, rubber, composites, wood, or any other suitable material or combination thereof. The garment support 10 can include features such as inserts, engravings, etc. to achieve a desired appearance of the garment support 10 (e.g., as a clothing accessory). Additionally, the garment support can be made by 3D printing, machining, molding, injection molding, extrusion, or any suitable process or combination thereof.

Figure 4A:
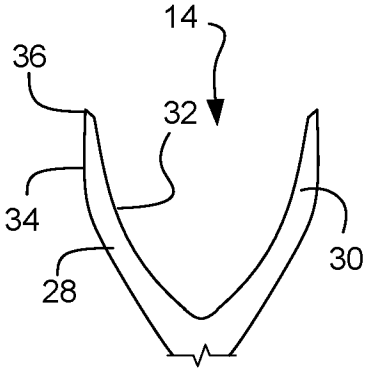
FIG. 4A is a detail view of a first embodiment of a top portion of the garment support.

FIG. 4A is a close-up view of the top portion 14 in a side view. The top portion 14 splits off with two legs 28, 30 to form the receptacle 24. The top portion 14 may be symmetrical or asymmetrical in other embodiments. In FIG. 4A, the legs 28, 30 include curved inner surfaces 32 and curved outer surfaces 34 that merge to a point or edge 36. The shape and configuration of the legs 28, 30 may be tailored to a particular shape of a pocket and/or garment to be supported, such as by minimizing surfaces that may snag on a pocket or may add too much bulk or to create a receptacle 24 shape matching an intended fold and/or volume of a garment (e.g., handkerchief) to be supported).

Figure 4B:
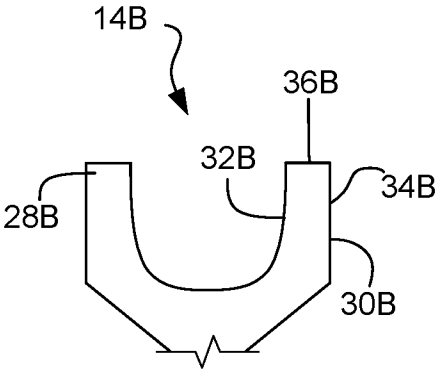
FIG. 4B is a detail view of a second embodiment of a top portion of the garment support.
Figure 4C:
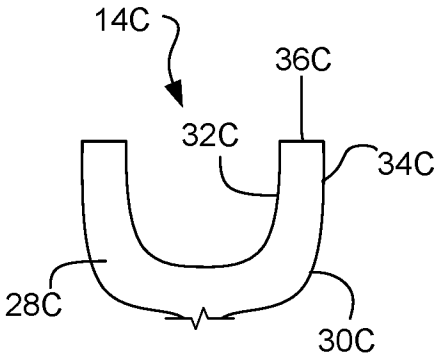
FIG. 4C is a detail view of a third embodiment of a top portion of the garment support.
Figure 4D:
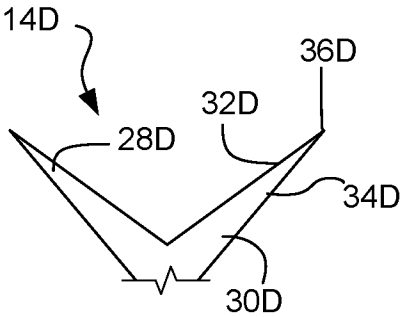
FIG. 4D is a detail view of a fourth embodiment of a top portion of the garment support.
Figure 4E:
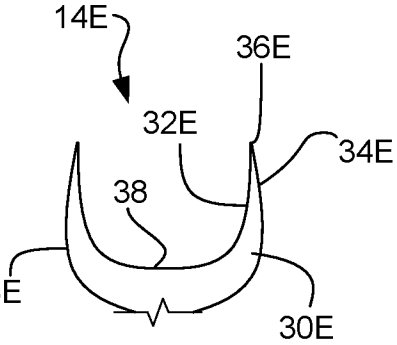
FIG. 4E is a detail view of a fifth embodiment of a top portion of the garment support.
Figure 4F:
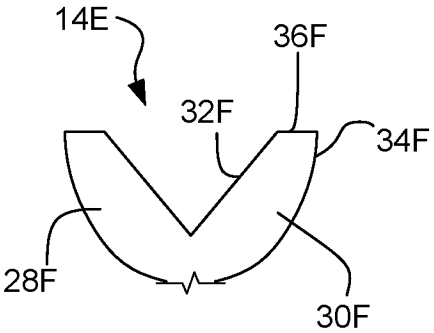
FIG. 4F is a detail view of a sixth embodiment of a top portion of the garment support.

FIGS. 4B-4F provide additional embodiments of the top portion 14, including various shapes and configurations that may be implemented. FIG. 4B includes a top portion 14B having two legs 28B, 30B configured with curved inner surfaces 32B and flat outer surfaces 34B that meet at a flat top surface 36B. FIG. 4C includes a top portion 14C having two legs 28C, 30C configured with curved inner surfaces 32C and curved outer surfaces 34C and a flat top surface 36C. FIG. 4D includes a top portion 14D having two legs 28D, 30D configured with flat inner surfaces 32D and flat outer surfaces 34D meeting at a point or edge 36D. FIG. 4E includes a top portion 14E having two legs 28E, 30E configured with curved inner surfaces 32E and curved outer surfaces 34E meeting at a point or edge 36E. Top portion 16E may be similar to the top portion 16 of FIG. 4A, but may also include a wider receiving area formed with a flat surface 38. FIG. 4F includes a top portion 14F having two legs 28F, 30F configured with flat inner surfaces 32D and curved outer surfaces 34D and a flat top surface 36D. These embodiments are exemplary and other configurations are possible, depending on the intended use and appearance of the garment support 10.

Figure 5:
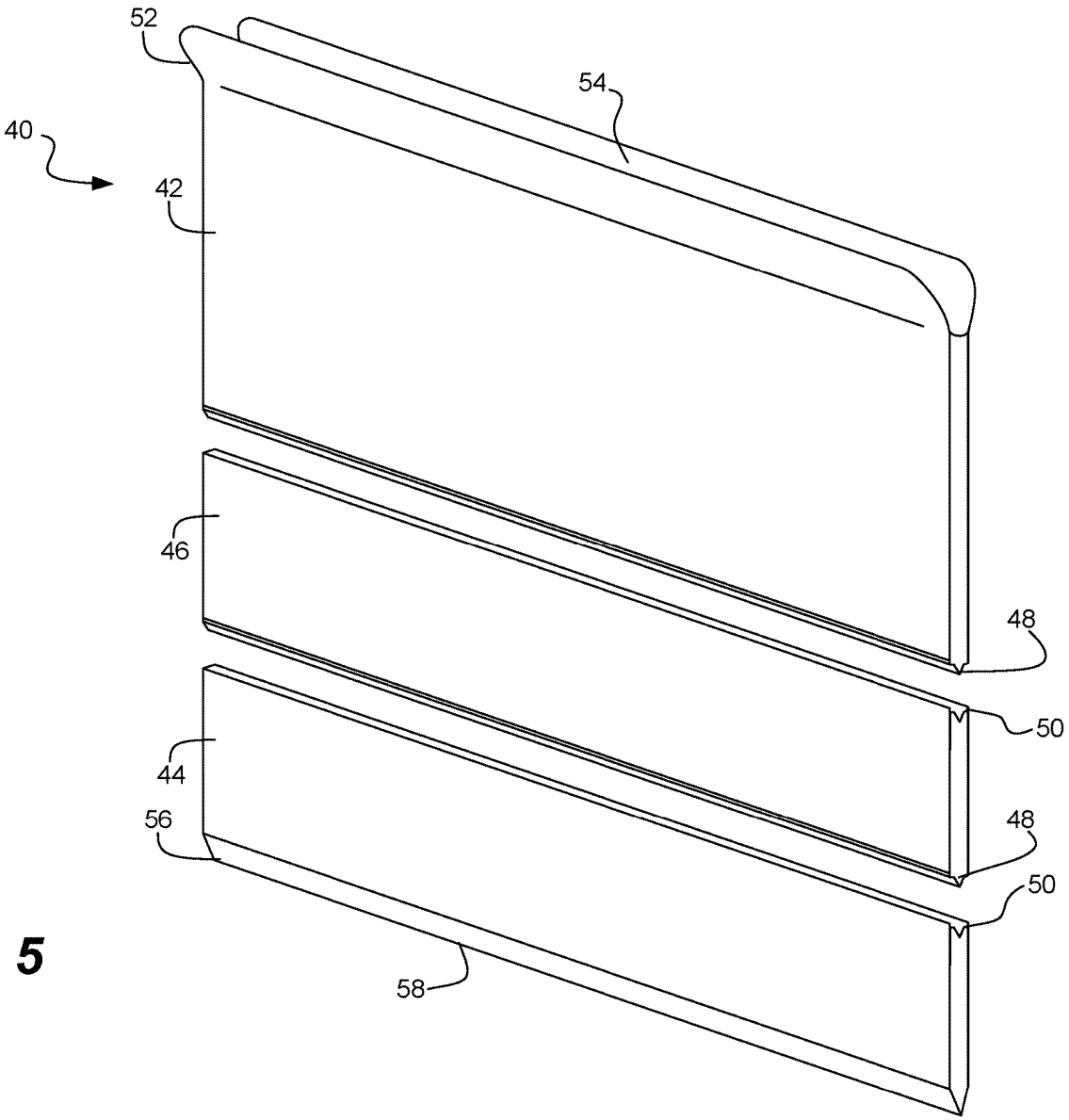
FIG. 5 is a perspective view of another exemplary garment support, consistent with disclosed embodiments.

FIG. 5 is a perspective view of another embodiment of a garment support 40. The garment support 40 includes multiple discrete pieces, including, for example, a first component 42, a second component 44, and a third component 46. The first component 42, second component 44, and third component 46 may be configured to fit together via connectors 48, 50 to thereby form a solid unitary structure with features the same as or similar to the garment support 10. For example, the first component 42 includes a top portion 52 having a receptacle 54 for receiving and supporting a garment, such as a handkerchief. The second component 44 may include a bottom portion 56 that converges to a point or thin edge 58. The first component 42 and second component 44 may be configured to fit together via connectors 48, 50 to form the garment support 40. The third component 46 may be a height extender insert configured to fit between the first and second components 42, 44 to provide additional height to the garment support 40. The modular components 42, 44, 46 provide a multiple height options depending on which components are used. For instance, the first component 42 may be used by itself as the garment support 40, the first component 42 and second component 44 may be combined to provide a garment support with a greater height. The first component 42, second component 44, and third component 46 may all be fitted together and used as a garment support with an even greater height. The various component may be packaged as a kit to provide a user with options depending on a desired height of the garment support 40 (e.g., depending of factors including pocket size, garment size, desired garment appearance, etc.).

Figure 7A:
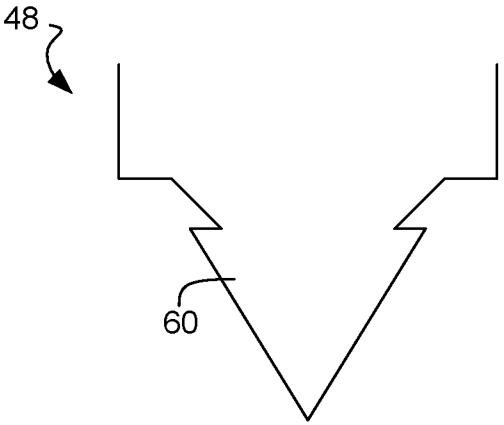
FIG. 7A is a detail view of a first connection mechanism for the garment support of FIG. 5, consistent with disclosed embodiments.
Figure 7B:
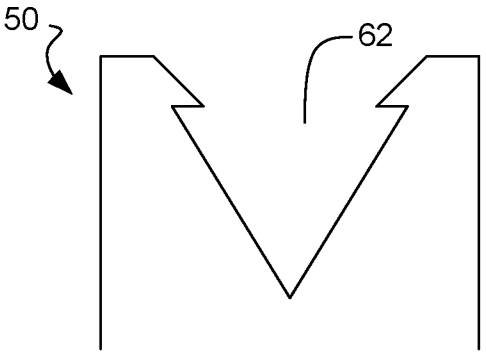
FIG. 7B is a detail view of a second connection mechanism for the garment support of FIG. 5, consistent with disclosed embodiments.

FIGS. 7A and 7B illustrate exemplary embodiments of the connectors 48, 50. The connector 48 may include a notched projection 60 shaped to fit within and mate with a notched aperture 62 (e.g., the second connector 50), such as through a snap fit via the corresponding notches in the sides of the connectors 48, 50. The connector 48 may be angled and come to a point or thin edge 58, similar to the edge 56 such that in situations in which only the first component 42 is used, a similar effect of tucking the garment support 40 into the bottom seam of a pocket is possible. The connectors 48, 50 are exemplary and other connection mechanisms between the components are possible.

The disclosed embodiments provide a garment support for providing a surface to prop up a garment, such as a handkerchief, inserted into a pocket. The garment support effectively raises the bottom of a pocket upward, providing a sturdy and effective surface for supporting a handkerchief and inhibiting the handkerchief material from slipping down into the pocket and out of view. The disclosed embodiments also include various options for the appearance of the garment support, which may be tailored to fit within an overall look or aesthetic by matching other accessories (e.g., buttons, cuff links, pins, etc.). Moreover, various mechanisms may be included to provide various size and shape options to a user, such as a mechanism that varies the height of a garment support either through an active mechanism or through providing multiple components that fit together and may be used separately from each other.

Although embodiments have been described in terms of exemplary features, they are not limited thereto. Rather, the appended claims should be construed broadly, to include other variants and embodiments, which may be made by those skilled in the art without departing from the scope and range of equivalents.

What is claimed is:

1. A garment support, comprising a body including a top portion, a middle portion, and a bottom portion, wherein the top portion includes a first leg and a second leg defining a receptacle extending along a length of the body to receive and support a garment, and wherein the top portion is thicker than the middle portion to create the receptacle; and the bottom portion includes a lower edge that is pointed along the length of the body.

2. The garment support of claim 1, wherein the first leg and the second leg define a U-shaped receptacle including curved inner and outer surfaces.

3. The garment support of claim 1, wherein the first leg and the second leg are pointed to define thin edges at an end of each of the first leg and the second leg, respectively.

4. The garment support of claim 1, wherein the body is rectangular.

5. The garment support of claim 4, wherein the top portion includes rounded corners at ends of the top portion.

6. The garment support of claim 1, further comprising a mechanism to adjust a height of the body.

7. The garment support of claim 1, wherein the first leg and the second leg include curved inner surfaces.

8. The garment support of claim 7, wherein the first leg and the second leg include curved outer surfaces.

9. The garment support of claim 8, wherein the first leg and the second leg are connected by a flat surface.

10. The garment support of claim 7, wherein the first leg and the second leg each include flat angled outer surfaces.

11. The garment support of claim 1, wherein the body includes a first component and a second component that is removable from the first component, and wherein the second component is the same length and generally the same shape as the first component.

12. The garment support of claim 1, wherein the body is made up of a first component and a separable second component.

13. The garment support of claim 12, wherein the first component includes the top portion and a first connector.

14. The garment support of claim 13, wherein the second component includes the bottom portion and a second connector to mate with the first connector.

15. The garment support of claim 14, wherein the first connector and the second connector include a notched projection and a notched aperture, respectively.

16. The garment support of claim 14, further comprising a third component including a third connector to mate with the first connector and a fourth connector to mate with the second connector.

17. A garment support, comprising a monolithic, rectangular body including a first portion, a second portion, and a third portion that extends between the first portion and the second portion, wherein:

the first portion includes a first leg and a second leg that each extend away from the second portion and the third portion, the first leg and the second leg extending away from each other such that a maximum thickness of the first portion is greater than a maximum thickness of the third portion and such that the first leg and the second leg together define a receptacle that extends along a length of the body, the receptacle sized and configured to receive and support at least a portion of a garment; and the second portion converges from the maximum thickness of the third portion to an edge having a thickness that is less than the maximum thickness of the first portion and the third portion, the edge extending along the length of the body.

* * * * *